US010500750B2

(12) United States Patent
Fujita et al.

(10) Patent No.: US 10,500,750 B2
(45) Date of Patent: Dec. 10, 2019

(54) CUTTING APPARATUS

(71) Applicant: Roland DG Corporation, Hamamatsu-shi, Shizuoka (JP)

(72) Inventors: Akira Fujita, Hamamatsu (JP); Kenji Matsushime, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 186 days.

(21) Appl. No.: 15/655,186

(22) Filed: Jul. 20, 2017

(65) Prior Publication Data

US 2018/0021969 A1 Jan. 25, 2018

(30) Foreign Application Priority Data

Jul. 21, 2016 (JP) ..... 2016-143240

(51) Int. Cl.
*B26D 5/26* (2006.01)
*B41J 11/66* (2006.01)
*B41J 2/005* (2006.01)

(52) U.S. Cl.
CPC ..... *B26D 5/26* (2013.01); *B41J 11/663* (2013.01); *B41J 2/005* (2013.01)

(58) Field of Classification Search
CPC ..... B26D 5/26; B41J 11/663; B41J 2/005
USPC ..... 83/286
See application file for complete search history.

(56) References Cited

U.S. PATENT DOCUMENTS 4,477,103 A * 10/1984 Bertolazzi ..... B42D 15/00 281/2
7,055,418 B2 * 6/2006 Maddalon ..... B26D 5/32 83/364
7,422,386 B2 * 9/2008 Ohmori ..... B26F 1/3806 347/29
7,509,068 B2 * 3/2009 Honma ..... B41J 3/60 399/401
7,839,513 B2 * 11/2010 Sammis ..... G06K 15/00 358/1.14
8,582,102 B2 * 11/2013 Guo ..... H01L 23/544 356/401
8,870,363 B2 * 10/2014 Ipponyari ..... B26D 1/045 101/224

(Continued)

FOREIGN PATENT DOCUMENTS

CN 102481793 A 5/2012
CN 102627036 A 8/2012

(Continued)

*Primary Examiner* — Ghassem Alie
*Assistant Examiner* — Bharat C Patel
(74) *Attorney, Agent, or Firm* — Keating & Bennett, LLP

(57) ABSTRACT

A cutting apparatus includes a crop mark print controller and a front/back determiner. The crop mark print controller prints a first crop mark on a front side of a medium and then print a second crop mark over the first crop mark. The second crop mark is larger in size than the first crop mark. The front/back determiner determines that the medium is placed, with its front side facing upward, when only the second crop mark is detected by a crop mark detector, and determine that the medium is placed, with its back side facing upward, when a pattern including the first crop mark and the second crop mark overlapping one another is detected by the crop mark detector.

8 Claims, 13 Drawing Sheets

(56) References Cited

U.S. PATENT DOCUMENTS

| | | | | |
|---|---|---|---|---|
| 9,003,971 | B2 * | 4/2015 | Haenni | B41J 3/42 101/481 |
| 9,055,174 | B2 * | 6/2015 | Tokura | H04N 1/00795 |
| 9,340,044 | B2 * | 5/2016 | Matsushita | B41J 11/663 |
| 9,440,463 | B2 * | 9/2016 | Kudo | B41J 11/663 |
| 9,848,098 | B2 * | 12/2017 | Mita | H04N 1/00748 |
| 9,881,241 | B2 * | 1/2018 | Narimatu | G03G 15/16 |
| 9,906,683 | B2 * | 2/2018 | Miyagi | H04N 1/3873 |
| 2004/0100549 | A1 | 5/2004 | Nebashi et al. | |
| 2012/0148326 | A1 | 6/2012 | Ipponyari et al. | |
| 2012/0200885 | A1 | 8/2012 | Matsuzawa | |
| 2013/0292898 | A1 * | 11/2013 | Miyamoto | B65H 9/20 271/227 |
| 2014/0354721 | A1 | 12/2014 | Kondo et al. | |
| 2015/0022579 | A1 | 1/2015 | Yoshizawa | |

FOREIGN PATENT DOCUMENTS

| | | | |
|---|---|---|---|
| CN | 104210233 | A | 12/2014 |
| JP | 57-152073 | A | 9/1982 |
| JP | 2001-260443 | A | 9/2001 |
| JP | 2002-011693 | A | 1/2002 |
| JP | 2011-155183 | A | 8/2011 |
| JP | 2012-187791 | A | 10/2012 |
| JP | 2013-099947 | A | 5/2013 |
| JP | 2015-020399 | A | 2/2015 |

* cited by examiner

CUTTING APPARATUS

CROSS REFERENCE TO RELATED APPLICATIONS

This application claims the benefit of priority to Japanese Patent Application No. 2016-143240 filed on Jul. 21, 2016. The entire contents of this application are hereby incorporated herein by reference.

BACKGROUND OF THE INVENTION

1. Field of the Invention

The present invention relates to cutting apparatuses.

2. Description of the Related Art

A cutting apparatus known in the related art is configured to cut a medium made of a sheet material, such as paper or resin. A cutting apparatus having a printing function to effect printing on a medium is also known in the related art. For example, JP 2001-260443 A discloses such a cutting apparatus. In one example, such a cutting apparatus prints an image on a medium and then cuts a portion of the medium surrounding the image with a cutter. Because the position of a cut line for the image is determined in advance, performing high-precision cutting makes it necessary to minimize a misalignment between the predetermined cut line and a path that the cutter follows.

To minimize such a misalignment, printing an image on a medium involves, as illustrated in FIG. 12, printing a plurality of circular crop marks C1, C2, C3, and C4 around the image. Cutting the medium involves detecting the positions of the crop marks C1 to C4, and effecting positioning of a cutting head in accordance with the positions of the crop marks C1 to C4. Using the crop marks C1 to C4 printed around the image in this manner enables high-precision positioning of the cutting head, resulting in an increase in cutting precision. A cutting apparatus of this type known in the art is disclosed in JP 2001-260443 A.

To create a label for a control panel or a special label, a user may have a desire to print an image on a transparent medium and then reverse the medium so as to perform cutting from the back side of the medium. In such a case, crop marks printed on the front side of the medium are also visible from the back side, so that cutting may be performed from the back side using the crop marks. The crop marks C1 to C4 known in the art, however, do not change in pattern when the medium is reversed, which means that the user is unable to determine which side of the medium is the front side of the medium and which side is the back side of the medium.

SUMMARY OF THE INVENTION

Accordingly, preferred embodiments of the present invention provide a cutting apparatus that determines which side of a medium is the front side of the medium and which side is the back side of the medium.

A cutting apparatus according to a preferred embodiment of the present invention includes a support, a print head, a cutting head, a printing controller, a cutting controller, a memory, and a crop mark detector. The support supports a medium made of a transparent material. The medium includes a front side and a back side opposite to the front side. The print head performs printing on the medium supported on the support. The cutting head cuts the medium supported on the support. The printing controller is configured or programmed to perform control to cause the print head to face the front side of the medium and print an image and a crop mark on the front side. The cutting controller is configured or programmed to perform control to cause the cutting head to face the medium and cut the medium. The memory stores a cut line which is provided for the image and along which the medium is to be cut by the cutting head when the medium supported on the support is placed, with the front side facing upward. The crop mark detector detects the crop mark. The crop mark includes a first crop mark and a second crop mark. The printing controller is configured or programmed to include a crop mark print controller to print the first crop mark on the front side of the medium with a first color and then print the second crop mark over the first crop mark with a second color different from the first color. The second crop mark is larger in size than the first crop mark such that the second crop mark covers the first crop mark. The cutting controller is configured or programmed to include a front/back determiner that determines that the medium supported on the support is placed, with the front side facing upward, when the second crop mark is detected by the crop mark detector and the first crop mark is not detected by the crop mark detector, and determines that the medium supported on the support is placed, with the back side facing upward, when a pattern including the first crop mark and the second crop mark overlapping one another is detected by the crop mark detector.

A cutting apparatus according to another preferred embodiment of the present invention includes a support, a print head, a cutting head, a printing controller, a cutting controller, a memory, and a crop mark detector. The support supports a medium made of a transparent material. The medium includes a front side and a back side opposite to the front side. The print head performs printing on the medium supported on the support. The cutting head cuts the medium supported on the support. The printing controller is configured or programmed to perform control to cause the print head to face the front side of the medium and print an image and a crop mark on the front side. The cutting controller is configured or programmed to perform control to cause the cutting head to face the medium and cut the medium. The memory stores a cut line which is provided for the image and along which the medium is to be cut by the cutting head when the medium supported on the support is placed, with the front side facing upward. The crop mark detector is detects the crop mark. The crop mark includes a first crop mark and a second crop mark. The printing controller is configured or programmed to include a crop mark print controller to print the first crop mark on the front side of the medium with a first color and then print the second crop mark over the first crop mark with a second color different from the first color. The second crop mark is smaller in size than the first crop mark such that the second crop mark is located inside the first crop mark. The cutting controller is configured or programmed to include a front/back determiner that determines that the medium supported on the support is placed, with the front side facing upward, when a pattern including the first crop mark and the second crop mark overlapping one another is detected by the crop mark detector, and determines that the medium supported on the support is placed, with the back side facing upward, when the first crop mark is detected by the crop mark detector and the second crop mark is not detected by the crop mark detector.

A cutting apparatus according to still another preferred embodiment of the present invention includes a support, a cutting head, a cutting controller, a memory, and a crop mark detector. The support supports a medium made of a transparent material. The medium includes a front side and a back side opposite to the front side. The front side has an image and a crop mark printed thereon. The cutting head cuts the medium supported on the support. The cutting controller is configured or programmed to perform control to cause the cutting head to face the medium and cut the medium. The memory stores a cut line which is provided for the image and along which the medium is to be cut by the cutting head when the medium supported on the support is placed, with the front side facing upward. The crop mark detector detects the crop mark. The crop mark includes a first crop mark and a second crop mark. The first crop mark is printed on the front side of the medium with a first color. The second crop mark is printed over the first crop mark with a second color different from the first color. The second crop mark is larger in size than the first crop mark such that the second crop mark covers the first crop mark. The cutting controller is configured or programmed to include a front/back determiner that determines that the medium supported on the support is placed, with the front side facing upward, when the second crop mark is detected by the crop mark detector and the first crop mark is not detected by the crop mark detector, and determines that the medium supported on the support is placed, with the back side facing upward, when a pattern including the first crop mark and the second crop mark overlapping one another is detected by the crop mark detector.

A cutting apparatus according to yet another preferred embodiment of the present invention includes a support, a cutting head, a cutting controller, a memory, and a crop mark detector. The support supports a medium made of a transparent material. The medium includes a front side and a back side opposite to the front side. The front side has an image and a crop mark printed thereon. The cutting head cuts the medium supported on the support. The cutting controller is configured or programmed to perform control to cause the cutting head to face the medium and cut the medium. The memory stores a cut line which is provided for the image and along which the medium is to be cut by the cutting head when the medium supported on the support is placed, with the front side facing upward. The crop mark detector detects the crop mark. The crop mark includes a first crop mark and a second crop mark. The first crop mark is printed on the front side of the medium with a first color. The second crop mark is printed over the first crop mark with a second color different from the first color. The second crop mark is smaller in size than the first crop mark such that the second crop mark is located inside the first crop mark. The cutting controller is configured or programmed to include a front/back determiner that determines that the medium supported on the support is placed, with the front side facing upward, when a pattern including the first crop mark and the second crop mark overlapping one another is detected by the crop mark detector, and determines that the medium supported on the support is placed, with the back side facing upward, when the first crop mark is detected by the crop mark detector and the second crop mark is not detected by the crop mark detector.

The cutting apparatus described above uses the crop mark including the first crop mark and the second crop mark printed over the first crop mark and different in size and color from the first crop mark. Thus, the cutting apparatus determines which side of the medium is the front side of the medium and which side is the back side of the medium.

Various preferred embodiments of the present invention provide cutting apparatuses that determine which side of a medium is the front side of the medium and which side is the back side of the medium.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
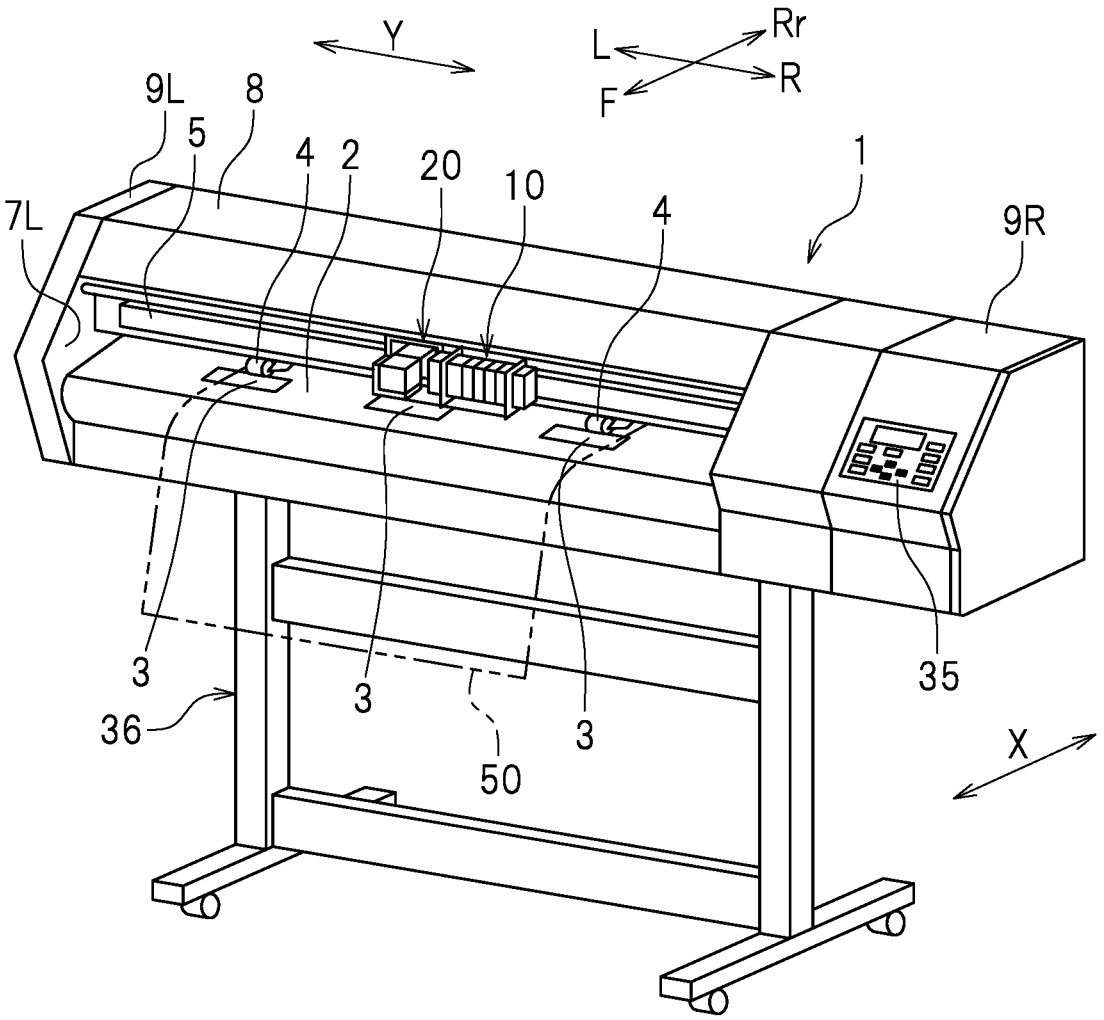
FIG. 1 is a perspective view of a cutting apparatus according to a first preferred embodiment of the present invention.

Preferred embodiments of the present invention will be described below with reference to the drawings. As illustrated in FIG. 1, a cutting apparatus 1 according to a first preferred embodiment of the present invention is a "printer/cutter" capable of effecting printing and cutting on a medium 50 made of a transparent material. Although not illustrated, the medium 50 according to this preferred embodiment is a transparent resin sheet. The medium 50, however, is not limited to any particular type of medium. The medium 50 may be any transparent medium that allows printing and cutting to be effected thereon. As used herein, the term "transparent medium 50" may refer to the medium 50 that is completely colorless and transparent or the medium 50 that is slightly colored. In other words, the term "transparent medium 50" may refer to the medium 50 that is translucent to such an extent that color and shape of an image printed on the front side of the medium 50 are visually recognizable from the back side of the medium 50. The medium 50 is preferably translucent to such an extent that crop marks (which will be described below) printed on one surface of the medium 50 are detectable from the other surface of the medium 50 by a sensor 25 (which will be described below). The medium 50 may contain bubbles and/or colored fine particles. As used herein, the terms "cutting" and "to cut" refer to not only cutting an entirety of the medium 50 in its thickness direction but also cutting a portion of the medium 50 in its thickness direction.

As illustrated in FIG. 1, the cutting apparatus 1 includes: a platen 2 to support the medium 50; a print head 10 to effect printing on the medium 50 supported on the platen 2; and a cutting head 20 to cut the medium 50 supported on the platen 2. Although described in more detail below, the print head 10 and the cutting head 20 are movable in a direction Y in FIG. 1. The direction Y will hereinafter be referred to as a "main scanning direction" or a "right-left direction". A direction X perpendicular to the direction Y will hereinafter be referred to as a "sub-scanning direction" or a "front-rear direction". The main scanning direction corresponds to the width direction of the medium 50. The sub-scanning direction corresponds to the longitudinal direction of the medium 50. The reference signs F, Rr, R, and L in FIG. 1 respectively represent front, rear, right, and left.

The print head 10 according to this preferred embodiment is an inkjet head to discharge ink. A printing method to be performed by the print head 10, however, is not limited to an inkjet method. In other words, the print head 10 is not limited to an inkjet head. In one example, the print head 10 may be a print head to effect dot-impact printing.

The platen 2 is provided with grit rollers 3. Although not illustrated in FIG. 1, a feed motor 61 (see FIG. 3) is driven so as to rotate the grit rollers 3. A guide rail 5 is provided above the platen 2. The guide rail 5 extends in the right-left direction. The lower portion of the guide rail 5 is provided with pinch rollers 4. The pinch rollers 4 are disposed above the grit rollers 3. The pinch rollers 4 are swingable upward and downward such that each pinch roller 4 moves toward and away from an associated one of the grit rollers 3. With the medium 50 sandwiched between each pinch roller 4 and the associated grit roller 3, rotation of the grit rollers 3 conveys the medium 50 forward or rearward. FIG. 1 illustrates only three grit rollers 3 and only two pinch rollers 4, but in reality, more than three grit rollers 3 and more than two pinch rollers 4 may be arranged in the main scanning direction. The grit rollers 3 and the feed motor 61 define a first moving mechanism to move the medium 50 relative to the print head 10 and the cutting head 20 in the sub-scanning direction.

Figure 2A:
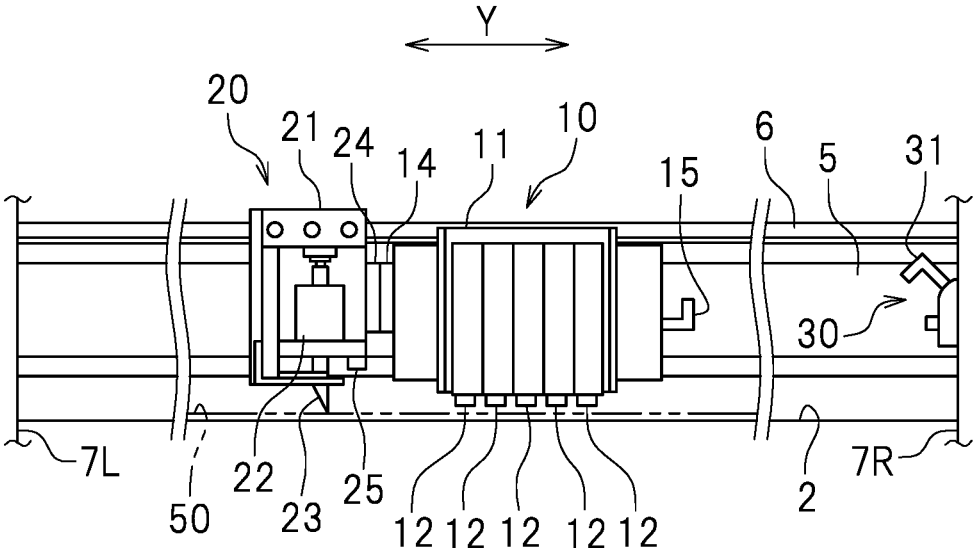
FIG. 2A is a front view of a print head and a cutting head.

As illustrated in FIG. 2A, the print head 10 is supported on the guide rail 5 via a carriage 11. The cutting head is supported on the guide rail 5 via a carriage 21. The carriage 11 and the carriage 21 are each in engagement with the guide rail 5 such that the carriage 11 and the carriage 21 are each movable in the right-left direction.

As illustrated in FIG. 2A, a cutter 23 is attached to the carriage 21, with a solenoid 22 interposed therebetween. The solenoid 22 is controlled by a controller 60 (see FIG. 3). Turning the solenoid 22 ON/OFF moves the cutter 23 in the up-down direction, so that the cutter 23 comes into contact with the medium 50 or moves away from the medium 50. The cutting head 20 is provided with the sensor 25 to detect crop marks (which will be described below). The sensor 25 is not limited to any particular type of sensor. Any of various conventionally used sensors, such as an optical sensor, may be suitably utilized as the sensor 25. A connector 24 including a magnet is secured to the right portion of the carriage 21.

A belt 6 is secured to the upper rear surface of the carriage 21. The belt 6 extends in the right-left direction. The belt 6 is connected to a scan motor 62 (see FIG. 3). Rotation of the scan motor 62 causes the belt 6 to run in the right-left direction. This moves the carriage 21 in the right-left direction. The scan motor 62 is controlled by the controller 60. The carriage 21, the guide rail 5, and the scan motor 62 provide a second moving mechanism to move the print head 10 and the cutting head 20 in the main scanning direction.

The carriage 11 for the print head 10 supports recording heads 12. Each recording head 12 includes a nozzle (not illustrated) to discharge ink. In this preferred embodiment, five recording heads 12 preferably are supported on the carriage 11, for example. The five recording heads 12 discharge ink of five different colors, e.g., yellow ink, magenta ink, cyan ink, black ink, and white ink. The number of recording heads 12, however, is not limited to five. Each recording head 12 may discharge ink of any other color.

A connector 14 made of a magnet is provided on the left portion of the carriage 11. The connector 14 is detachably coupled to the connector 24 of the cutting head 20. In this preferred embodiment, the connectors 14 and 24 utilize a magnetic force. The connectors 14 and 24, however, are not limited to ones that utilize a magnetic force. Each of the connectors 14 and 24 may be any other connector that includes an engaging member, for example. An L-shaped receiving metal fitting 15 is provided on the right portion of the carriage 11.

A side frame 7R is disposed on the right end of the platen 2. A side frame 7L is disposed on the left end of the platen 2. The guide rail 5 is supported by the side frames 7R and 7L. The right side frame 7R is provided with a locking device 30 to lock the print head 10 at a standby position. The locking device 30 preferably includes: a receiving metal fitting 31 to be caught by the receiving metal fitting 15; and a locking solenoid 32 (see FIG. 3) to move the receiving metal fitting 31 between a locking position (see FIG. 2B) and a non-locking position (see FIG. 2A). The locking solenoid 32 is controlled by the controller 60.

Figure 2B:
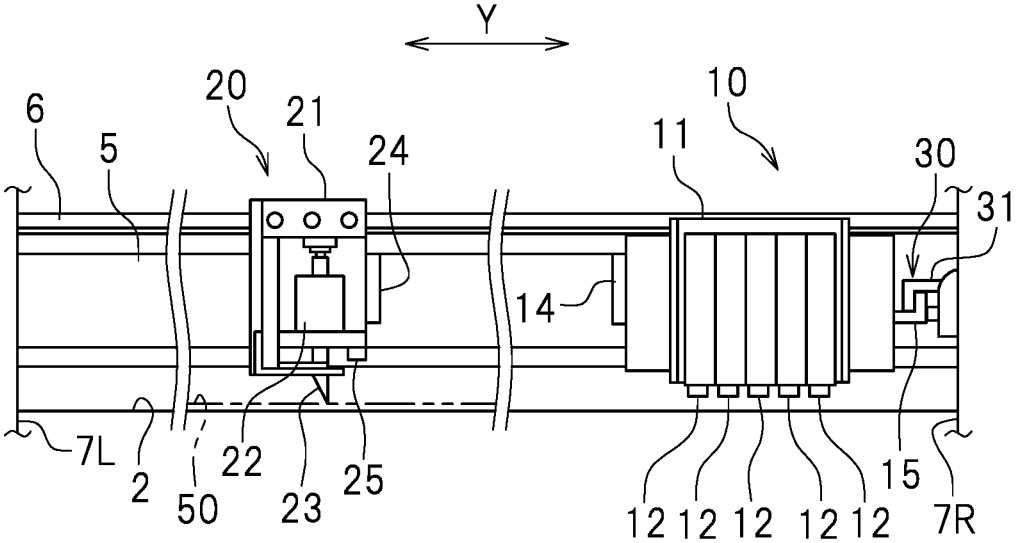
FIG. 2B is a front view of the print head and the cutting head.

As illustrated in FIG. 2A, effecting printing by the print head 10 involves setting the receiving metal fitting 31 at the non-locking position. Rightward movement of the carriage 21 for the cutting head 20 brings the connector 24 into contact with the connector 14, so that the carriage 21 is coupled to the carriage 11. This enables the print head 10 to move in the right-left direction together with the cutting head 20. As illustrated in FIG. 2B, effecting cutting by the cutting head 20 involves placing the print head 10 at the standby position and setting the receiving metal fitting 31 of the locking device 30 at the locking position. This prevents movement of the print head 10. Leftward movement of the carriage 21 brings the connector 24 away from the connector 14, so that the carriage 21 is decoupled from the carriage 11. Thus, the cutting head 20 is movable in the right-left direction, with the print head 10 located at the standby position.

As illustrated in FIG. 1, the cutting apparatus 1 further includes an upper cover 8. The upper cover 8 defines an upper housing. A side cover 9R is provided on the right of the side frame 7R (see FIG. 2A). A side cover 9L is provided on the left of the side frame 7L. An operation panel 35 is disposed on the front surface of the right side cover 9R. The operation panel 35 includes buttons and a display. A stand 36 is provided below the platen 2. The stand 36 is fitted with casters.

Although not illustrated, the cutting apparatus 1 further includes a feed roller. The medium 50 that is to undergo printing is wound around the feed roller. The feed roller is disposed obliquely below and rearward of the platen 2. During printing, the medium 50 wound around the feed roller is conveyed forward over the platen 2.

Figure 3:
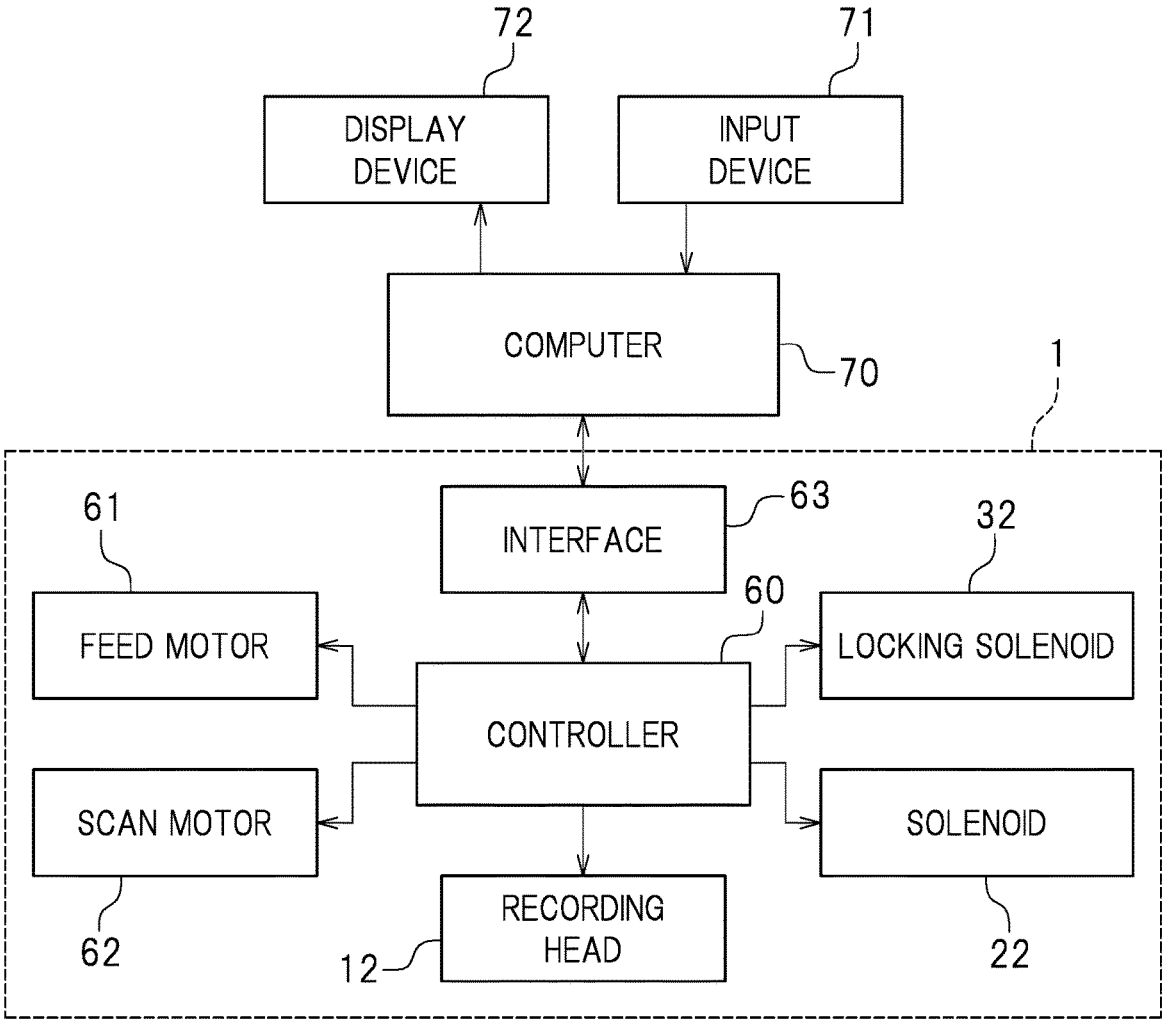
FIG. 3 is a block diagram of a control system for the cutting apparatus according to the first preferred embodiment of the present invention.

The controller 60 is a microcomputer that includes a central processing unit (CPU), a read-only memory (ROM), and a random-access memory (RAM). The CPU, ROM, and RAM are not illustrated. As illustrated in FIG. 3, the controller 60 is connected to an external computer 70 through an interface 63 such that the controller 60 is in wireless or wired communication with the computer 70. The computer 70 stores data used to perform printing and cutting. The controller 60 receives data from the computer 70 so as to control the feed motor 61, the scan motor 62, the locking device 30, the cutting head 20, and the print head 10. The computer 70 is connected with an input device 71 including a keyboard and/or a mouse; and a display device 72 including a liquid crystal display.

Figure 4:
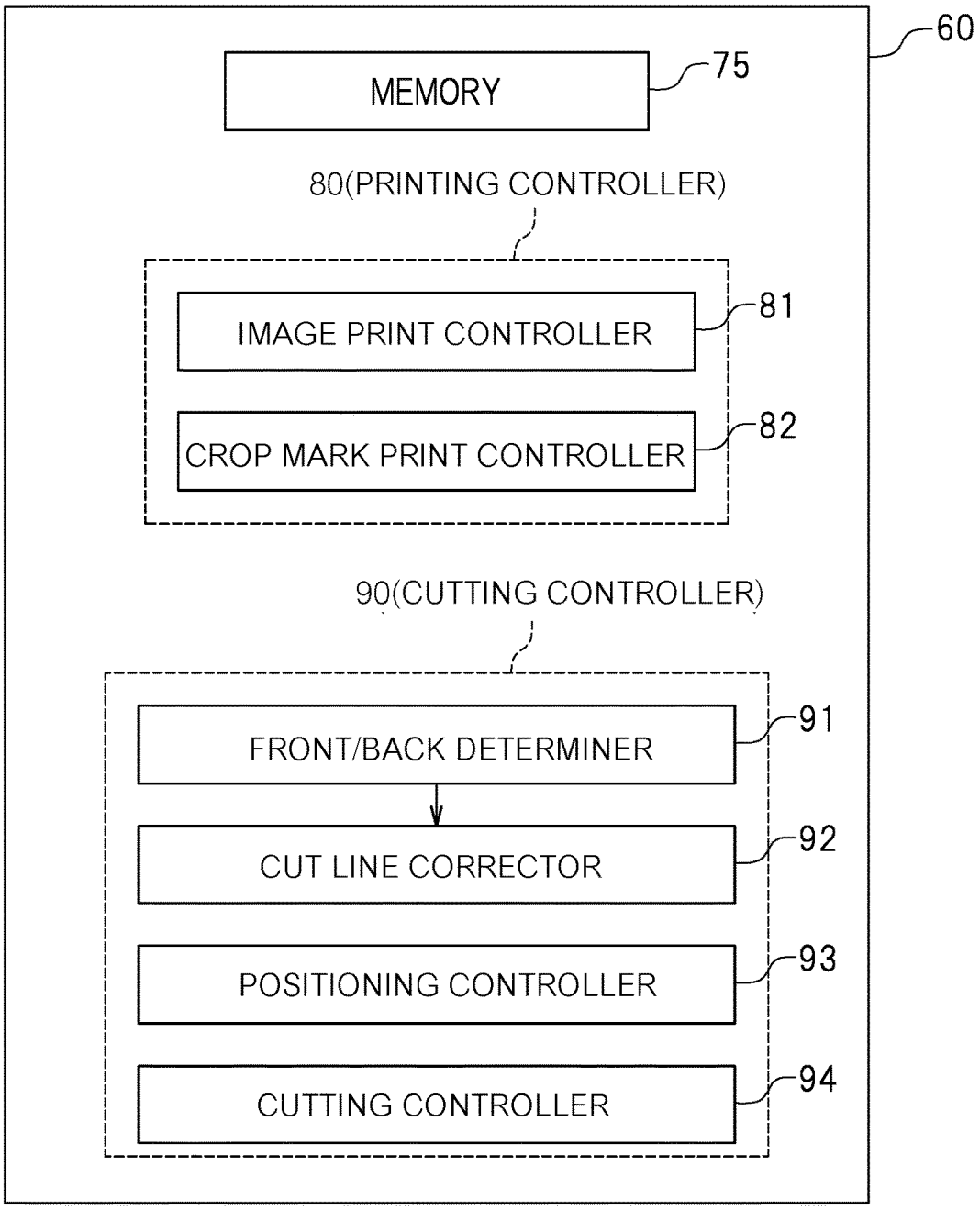
FIG. 4 is a block diagram of a controller.

FIG. 4 is a functional block diagram of the controller 60. In other words, FIG. 4 is a block diagram illustrating functions that the controller 60 is configured or programmed to perform upon receiving data from the computer 70. The functions of the components of the controller 60 (which will be described below) may be implemented by a program or programs. The program(s) is read into the controller 60 from a storage medium, such as a CD or DVD, for example. The program may be downloaded from the Internet. The functions of the components of the controller 60 may be implemented by processor(s) and/or circuit(s), for example. As illustrated in FIG. 4, the controller 60 includes a memory 75, a printing controller 80, and a cutting controller 90.

The memory 75 stores: print data to be used when an image is printed; and cut data indicative of a cut line which is provided for the image and along which the medium 50 is to be cut by the cutting head 20 when the medium 50 supported on the platen 2 is placed, with the front side of the medium 50 facing upward. These pieces of data are transmitted from the external computer 70, for example.

The printing controller 80 is configured or programmed to perform control to cause the print head 10 to face the front side of the medium 50 and print an image on the front side of the medium 50. In this preferred embodiment, the printing controller 80 causes each recording head 12 of the print head 10 to discharge ink, while moving the print head 10 in the main scanning direction by driving the scan motor 62. Thus, printing is effected for a single scanning line. Once the movement of the print head 10 in the main scanning direction is completed, the feed motor 61 is driven so as to convey the medium 50 to the position of a next scanning line in the sub-scanning direction. Once the conveyance of the medium 50 in the sub-scanning direction is completed, the scan motor 62 is driven again and the print head 10 is also driven so as to effect printing for the next scanning line. Subsequently, similar operations are repeated until the end of printing.

The cutting controller 90 is configured or programmed to perform control to cause the cutting head 20 to face the medium and cut the medium 50. In this preferred embodiment, the cutting controller 90 drives the scan motor 62 and the feed motor 61 so as to move the cutting head 20 two-dimensionally relative to the medium 50. Turning the solenoid 22 ON enables the cutter 23 to be pressed against the medium 50. With the cutter 23 pressed against the medium 50, the cutting head 20 is moved relative to the medium 50. Thus, the medium 50 is cut along any cut line.

The printing controller 80 is configured or programmed to include an image print controller 81 and a crop mark print controller 82. The cutting controller 90 is configured or programmed to include a front/back determiner 91, a cut line corrector 92, a positioning controller 93, and a cutting controller 94. Operations to be performed by these components will be described below.

Figure 5:
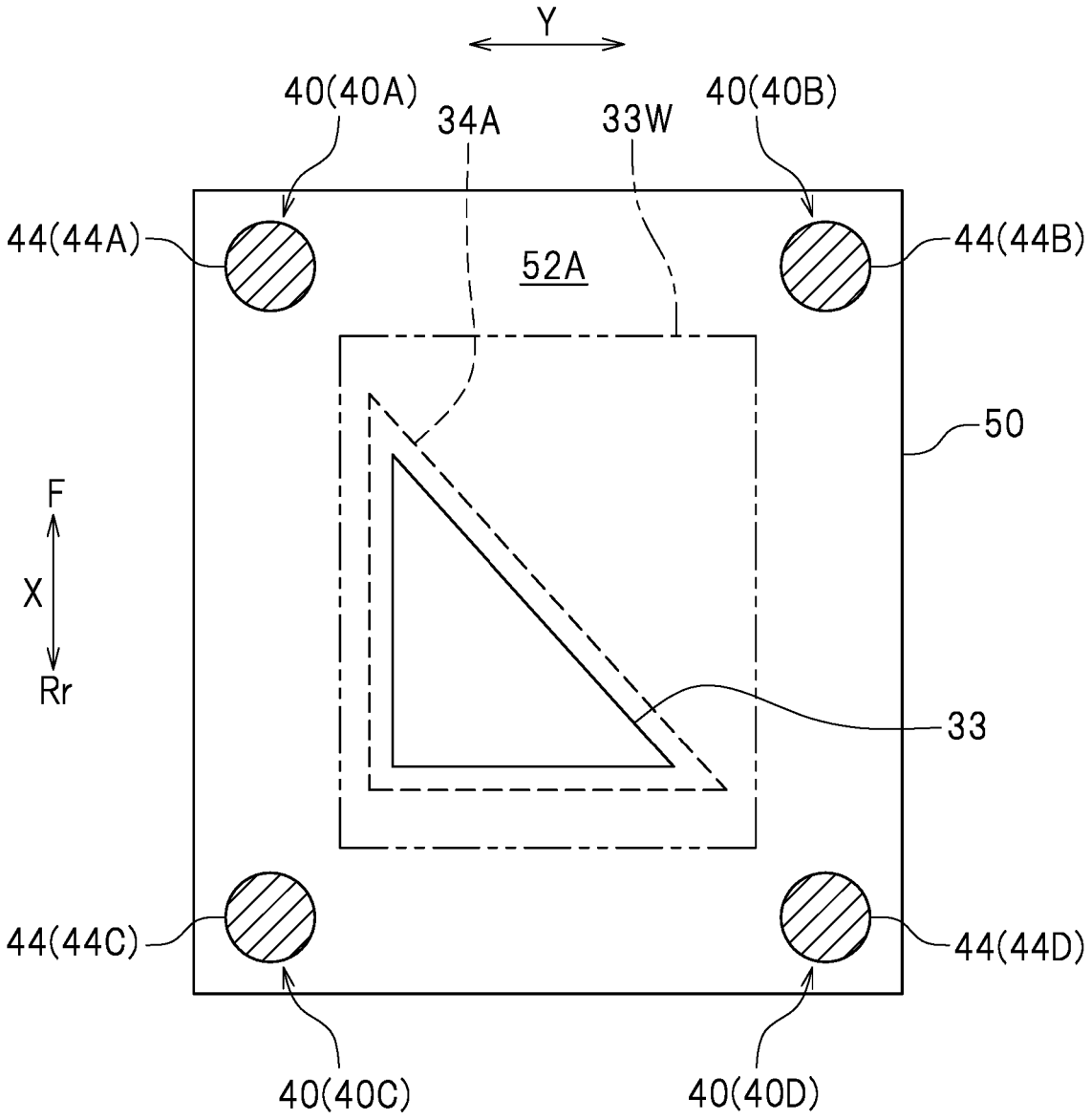
FIG. 5 is a plan view of the front side of a medium on which an image and crop marks according to the first preferred embodiment of the present invention are printed.
Figure 6:
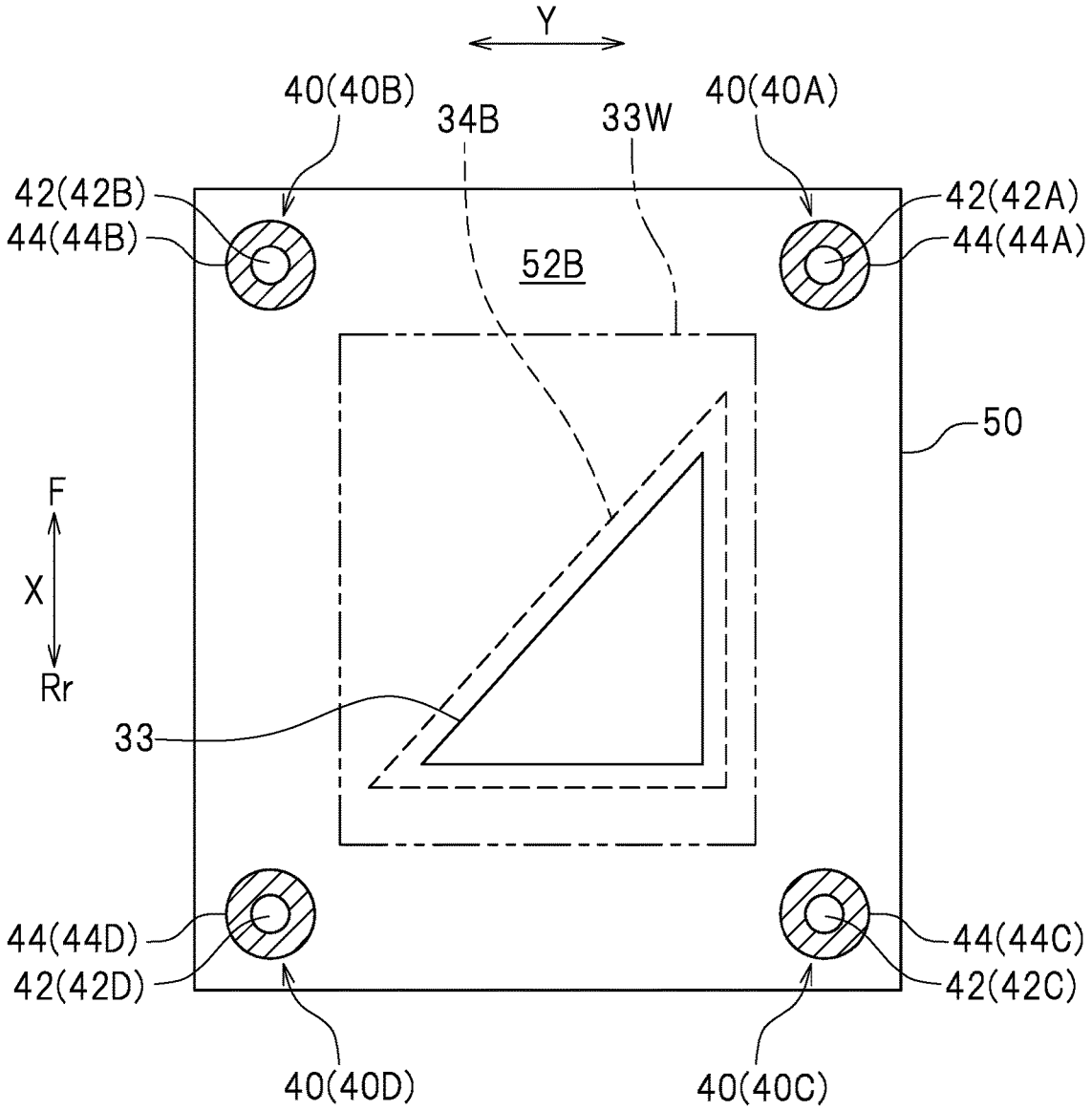
FIG. 6 is a plan view of the back side of the medium according to the first preferred embodiment of the present invention.

The following description discusses exemplary operations to be performed by the cutting apparatus 1. A surface of the medium 50 on which an image is to be printed is defined as a "front side" and will hereinafter be referred to as a "front side 52A". A surface of the medium 50 opposite to the front side of the medium 50 is defined as a "back side" and will hereinafter be referred to as a "back side 52B". FIG. 5 is a plan view of the front side 52A of the medium 50 on which an image 33 and crop marks 40 are printed. FIG. 6 is a plan view of the back side 52B of the medium 50. Referring to FIG. 5, the following description discusses how the cutting apparatus 1 prints the image 33 on the front side 52A of the medium 50 and cuts a portion of the medium 50 surrounding the image 33. The broken line indicated by the reference sign 34A represents a cut line along which the cutting head 20 cuts the medium 50. As used herein, the term "image" refers to an image formed on the medium 50 by the print head 10. The image may be in any form. Examples of the image include a character, a sign, a pattern, and a photograph.

First, the computer 70 transmits image data to the controller 60. Then, the printing controller 80 prints the image 33 and the crop marks 40 on the medium 50. The upward direction in FIG. 5 corresponds to the forward direction, and the downward direction in FIG. 5 corresponds to the rearward direction. The cutting apparatus 1 effects printing while conveying the medium 50 forward. Thus, printing is effected downward in the up-down direction in FIG. 5.

As illustrated in FIGS. 5 and 6, each crop mark 40 includes a first crop mark 42 and a second crop mark 44. Each first crop mark 42 is printed on the front side 52A of the medium 50 with a first color. Each second crop mark 44 is larger in size than the associated first crop mark 42 such that each second crop mark 44 covers the associated first crop mark 42. Each second crop mark 44 is printed over the associated first crop mark 42 with a second color different from the first color. Thus, when viewed from the front side 52A of the medium 50, each crop mark 40 is recognized as the second crop mark 44 as illustrated in FIG. 5. When viewed from the back side 52B of the medium 50, each crop mark 40 is recognized as a pattern including the first crop mark and the second crop mark 44 overlapping one another as illustrated in FIG. 6. In this preferred embodiment, each first crop mark 42 is defined by a white circle. The shape of each first crop mark 42 is not limited to a circular shape. The color of each first crop mark 42 is not limited to white. Each second crop mark 44 is defined by a black circle larger in diameter than the white circle of the associated first crop mark 42. The shape of each second crop mark 44 is not limited to a circular shape. The color of each second crop mark 44 is not limited to black.

In this preferred embodiment, the crop marks 40 include four crop marks, i.e., a crop mark 40A, a crop mark 40B, a crop mark 40C, and a crop mark 40D. Each of the crop marks 40A to 40D is printed on a portion of the medium 50 outward of an associated one of four corners of a rectangular region 33W that includes the image 33. In FIG. 5, the crop mark 40A is printed on a portion of the medium 50 located diagonally above and leftward of the rectangular region 33W, the crop mark 40B is printed on a portion of the medium 50 located diagonally above and rightward of the rectangular region 33W, the crop mark 40C is printed on a portion of the medium 50 located diagonally below and leftward of the rectangular region 33W, and the crop mark 40D is printed on a portion of the medium 50 located diagonally below and rightward of the rectangular region 33W. The crop mark 40B is located away from the crop mark 40A in the main scanning direction. The crop mark 40C is located away from the crop mark 40A in the sub-scanning direction. The crop mark 40D is located away from the crop mark 40B in the sub-scanning direction and located away from the crop mark 40C in the main scanning direction. In this preferred embodiment, the crop marks 40A to 40D have the same or substantially the same shape and size. Specifically, the crop mark 40A includes a first crop mark 42A and a second crop mark 44A, the crop mark 40B includes a first crop mark 42B and a second crop mark 44B, the crop mark 40C includes a first crop mark 42C and a second crop mark 44C, and the crop mark 40D includes a first crop mark 42D and a second crop mark 44D. The first crop marks 42A to 42D have the same or substantially the same shape and size. The second crop marks 44A to 44D have the same or substantially the same shape and size. Alternatively, one or some of the crop marks 40A to 40D may be different in shape or size from other one(s) of the crop marks 40A to 40D.

When the cutting apparatus 1 prints the image 33, the controller 60 functions as the image print controller 81. When the cutting apparatus 1 prints the crop marks 40A to 40D, the controller 60 functions as the crop mark print controller 82. The image 33 is printed by the image print controller 81. The crop marks 40A to 40D are printed by the crop mark print controller 82. In this preferred embodiment, printing is effected on the medium 50 from front to back such that the image 33 and the crop marks 40A to 40D are sequentially printed on the medium 50.

After printing the image 33 and the crop marks 40A to 40D, the cutting apparatus 1 cuts the medium 50 along the cut line 34A. To sufficiently dry the medium 50 that has undergone printing, this preferred embodiment performs: cutting a portion of the medium 50 rearward of the crop marks 40C and 40D in the main scanning direction after printing; removing the medium 50 from the cutting apparatus 1; and drying the medium 50 at a location outside of the cutting apparatus 1. After being dried, the medium 50 is placed on the platen 2 of the cutting apparatus 1 again so as to start cutting.

Suppose that a protection sheet is affixed to a printed surface, or a label for a control panel or a special label is created. In such a case, the image 33 may be printed on the front side 52A of the medium 50, and then the medium 50 may be reversed so as to effect cutting from the back side 52B. When cutting is effected from the back side 52B of the medium 50, the cut line 34A stored in the memory 75 needs to be corrected such that the cut line 34A assumes an inverted position. In this case, the cut line 34A is typically converted into a cut line 34B that is a mirror image of the cut line 34A. To determine whether the cut line 34A needs to be corrected for cutting, the cutting apparatus 1 determines which side of the medium 50 is the front side 52A of the medium 50 and which side is the back side 52B of the medium 50 before cutting the medium 50 along the cut line 34A. This determination will be referred to as a "front/back determination".

Making a front/back determination on the medium 50 involves using the crop mark 40 including the first crop mark 42 and the second crop mark 44 printed over the first crop mark 42, larger in size than the first crop mark 42, and different in color from the first crop mark 42. When the sensor 25 detects only the second crop mark 44 (see FIG. 5) before cutting, the controller 60 determines that the medium 50 supported on the platen 2 is placed, with the front side 52A facing upward. When the sensor 25 detects a pattern including the first crop mark 42 and the second crop mark 44 overlapping one another (see FIG. 6), the controller 60 determines that the medium 50 supported on the platen 2 is placed, with the back side 52B facing upward.

The sensor 25 may detect the pattern of the crop mark 40 by a method known in the art. In one example, an infrared sensor is used as the sensor 25. This example involves detecting a difference between reflectance of infrared light from the first crop mark 42 and reflectance of infrared light from the second crop mark 44, thus enabling detection of the pattern of the crop mark 40. Specifically, assuming that the first crop marks 42 are white circles and the second crop marks 44 are black circles, the second crop marks 44 that are black in color absorb infrared light, but the first crop marks 42 that are white in color reflect infrared light. The sensor 25 outputs an ON detection signal when infrared light is absorbed and outputs an OFF detection signal when infrared light is reflected. Suppose that the sensor 25 scans the medium 50 and outputs an OFF detection signal (responsive to detection of a portion of the medium 50 outside the crop mark 40), an ON detection signal (responsive to detection of a portion of the medium 50 inside the crop mark 40, i.e., the second crop mark 44), and an OFF detection signal (responsive to detection of a portion of the medium 50 outside the crop mark 40) in this order. In this case, the controller 60 determines that the medium 50 is placed, with the front side 52A facing upward. Suppose the sensor 25 scans the medium 50 and outputs an OFF detection signal (responsive to detection of a portion of the medium 50 outside the crop mark 40), an ON detection signal (responsive to detection of a portion of the medium 50 inside the crop mark 40, i.e., the second crop mark 44), an OFF detection signal (responsive to detection of a portion of the medium 50 inside the crop mark 40, i.e., the first crop mark 42), an ON detection signal (responsive to detection of a portion of the medium 50 inside the crop mark 40, i.e., the second crop mark 44), and an OFF detection signal (responsive to detection of a portion of the medium 50 outside the crop mark 40) in this order. In this case, the controller 60 determines that the medium 50 is placed, with the back side 52B facing upward.

In this preferred embodiment, the sensor 25 detects the crop marks 40A to 40D in the following order: the lower left crop mark, the lower right crop mark, the upper left crop mark, and the upper right crop mark. In this preferred embodiment, the crop marks 40A to 40D have the same or substantially the same shape and size, so that detection of the first crop mark (i.e., the lower left crop mark in this preferred embodiment) makes it possible to make a front/back determination on the medium 50. Thus, this preferred embodiment skips the step of making a front/back determination on the medium 50 using the second and subsequent crop marks. Consequently, the sensor 25 does not have to search for the first crop marks 42.

Upon determining that the medium 50 is placed, with the back side 52B facing toward the cutting head 20, the controller 60 corrects received cut line data so that the cut line 34A for the image 33 assumes an inverted position (i.e., the position of the cut line 34B illustrated in FIG. 6). The medium 50 is then cut along the cut line 34B obtained by inverting the cut line 34A in accordance with the cut line data corrected.

In this preferred embodiment, the controller 60 effects positioning of the cutting head 20 before cutting the medium 50 along the cut line 34B. Positioning of the cutting head 20 involves using three or all four of the crop marks 40A to 40D. Specifically, the controller 60 effects positioning of the cutting head 20 in accordance with the positions of three or all four of the crop marks 40A to 40D, and then cuts the medium 50 along the cut line 34B for the image 33.

The positions of the crop marks 40A to 40D are detected by the sensor 25 and positioning of the cutting head 20 is effected using the detected crop marks 40A to 40D in known manners, and thus detailed description thereof will be omitted.

In making a front/back determination on the medium 50, the controller 60 functions as the front/back determiner 91. In correcting a cut line such that the cut line assumes an inverted position, the controller 60 functions as the cut line corrector 92. In effecting positioning of the cutting head 20, the controller 60 functions as the positioning controller 93. In cutting the medium 50, the controller 60 functions as the cutting controller 94. A front/back determination is made on the medium 50 by the front/back determiner 91. A cut line is corrected by the cut line corrector 92. Positioning of the cutting head 20 is effected by the positioning controller 93. The medium 50 is cut by the cutting controller 94.

As described above, the cutting apparatus 1 according to this preferred embodiment performs a front/back determination on the medium 50 using the crop mark 40 including the first crop mark 42 and the second crop mark 44 printed over the first crop mark 42, larger in size than the first crop mark 42, and different in color from the first crop mark 42. Upon determining that the medium 50 is placed, with the back side 52B facing upward, the cutting apparatus 1 automatically corrects a cut line such that the cut line assumes an inverted position. Thus, the cutting apparatus 1 effects suitable cutting on the medium 50 not only from the front side 52A but also from the back side 52B.

In this preferred embodiment, a total of four crop marks (i.e., the crop marks 40A to 40D) preferably are each printed on a portion of the front side 52A of the medium 50 outward of an associated one of the four corners of the rectangular region 33W including the image 33, and positioning of the cutting head 20 is effected in accordance with the positions of three or all four of the crop marks 40A to 40D, for example. This enables high-precision positioning of the cutting head 20, resulting in an increase in cutting precision. The above configuration allows positioning crop marks to be used to make a front/back determination. This makes it unnecessary to additionally provide crop marks used to make a front/back determination. Thus, the consumption of ink is lower and the time required to perform printing is shorter than when crop marks used to make a front/back determination are additionally provided.

The cutting apparatus 1 according to this preferred embodiment involves printing the four crop marks 40A to 40D having the same or substantially the same shape and size. If a front/back determination is made individually using each of the four crop marks 40A to 40D, the time required for movement of the sensor 25 increases, resulting in an increase in processing time. To solve such a problem, the cutting apparatus 1 according to this preferred embodiment involves printing the four crop marks 40A to 40D having the same or substantially the same shape and size, thus making it possible to make a front/back determination on the medium 50 by detecting the first crop mark and to skip the step of making a front/back determination on the medium 50 using the second and subsequent crop marks. Thus, the sensor 25 does not have to search for the first crop marks 42. This results in a reduction in the time required for movement of the sensor 25 and leads to an efficient cutting operation.

Second Preferred Embodiment

The cutting apparatus 1 according to a second preferred embodiment of the present invention involves printing asymmetrical crop marks 40 each including the first crop mark 42 whose center is deviated in one direction relative to the center of the second crop mark 44. Thus, the cutting apparatus 1 not only makes a front/back determination on the medium 50 but also determines the two-dimensional orientation of the medium 50.

Figure 7:
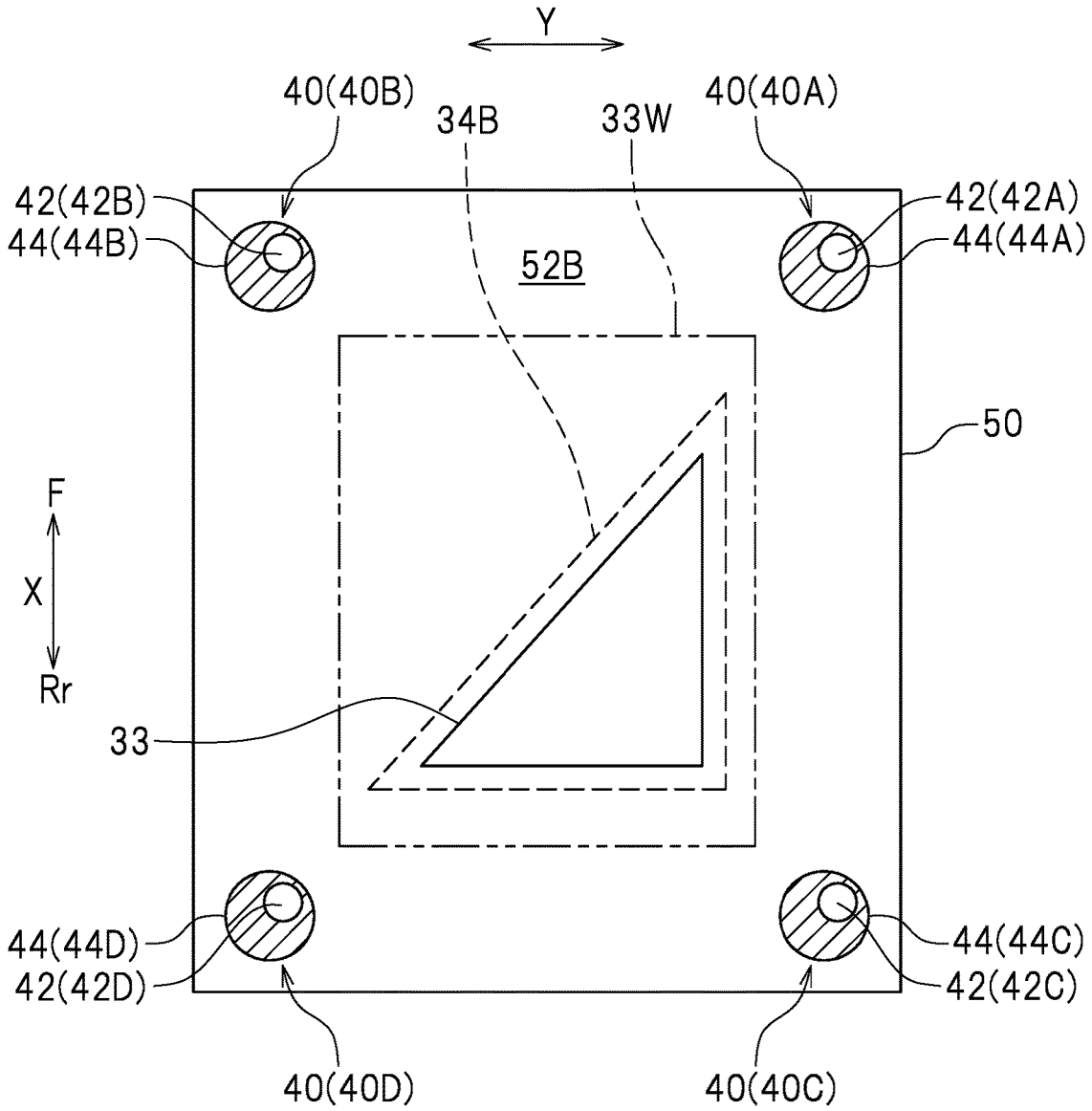
FIG. 7 is a plan view of the back side of the medium according to the second preferred embodiment of the present invention.

As illustrated in FIG. 7, the crop marks 40A to 40D according to this preferred embodiment each include the first crop mark 42 whose center is deviated in one direction relative to the center of the second crop mark 44 as viewed from the back side 52B of the medium 50. In this preferred embodiment, the center of each first crop mark 42 is deviated diagonally upward and rightward relative to the center of the associated second crop mark 44 in FIG. 7. In FIG. 7, the medium 50 that is in an "unrotated" state is placed on the platen 2, with the back side 52B facing toward the cutting head 20.

When the cutting apparatus 1 according to the second preferred embodiment effects cutting from the back side 52B of the medium 50, a user may remove the medium 50 from the cutting apparatus 1 after printing, reverse the medium 50, and then place the medium 50 on the platen 2 of the cutting apparatus 1 again so as to start cutting. The user, however, may accidentally rotate the medium 50 (or change the two-dimensional orientation of the medium 50) in placing the medium 50 on the platen 2. This may make it impossible to effect suitable cutting. To solve this problem, cutting effected by the cutting apparatus 1 according to this preferred embodiment involves determining whether the medium 50 is rotated before the cutting apparatus 1 cuts the medium 50 along a cut line.

Figure 8:
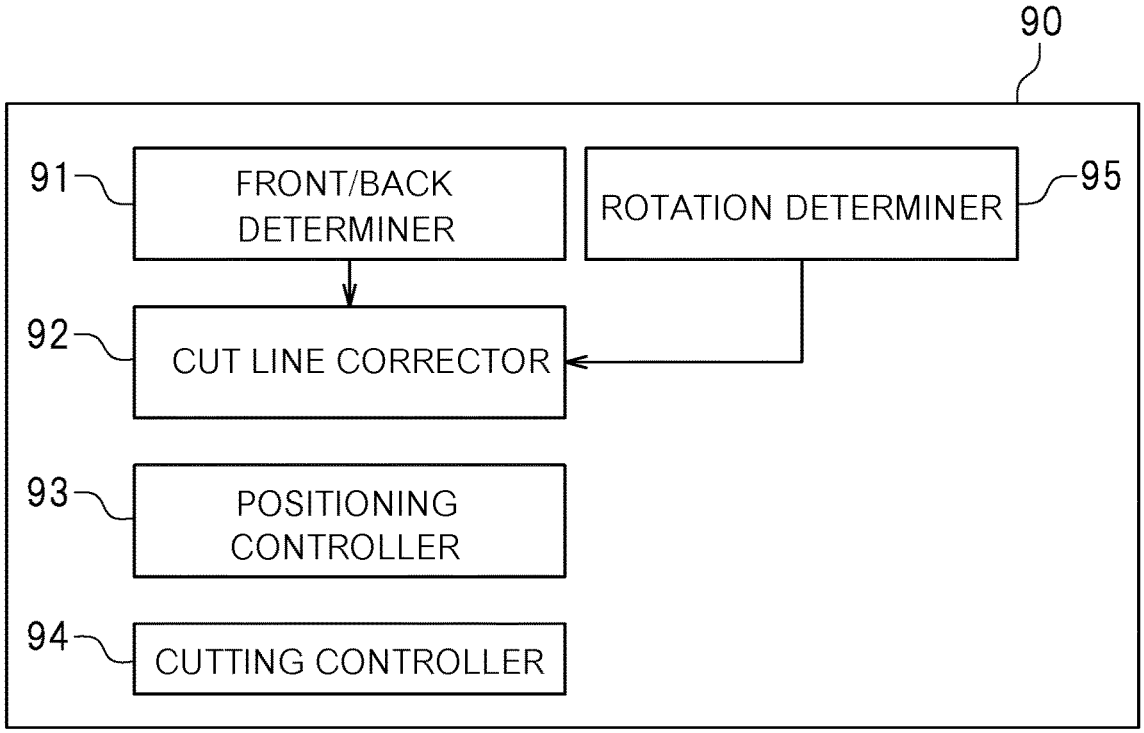
FIG. 8 is a block diagram of a cutting controller according to the second preferred embodiment of the present invention.

As illustrated in FIG. 8, the cutting controller 90 of the cutting apparatus 1 according to this preferred embodiment includes a rotation determiner 95, in addition to the front/back determiner 91, the cut line corrector 92, the positioning controller 93, and the cutting controller 94.

Similarly to the first preferred embodiment described above, the front/back determiner 91 determines that the medium 50 supported on the platen 2 is placed, with the front side 52A facing upward, when the sensor 25 has detected only the second crop mark 44, and determine that the medium 50 supported on the platen 2 is placed, with the back side 52B facing upward, when the sensor 25 has detected a pattern including the first crop mark 42 and the second crop mark 44 overlapping one another.

Figure 9:
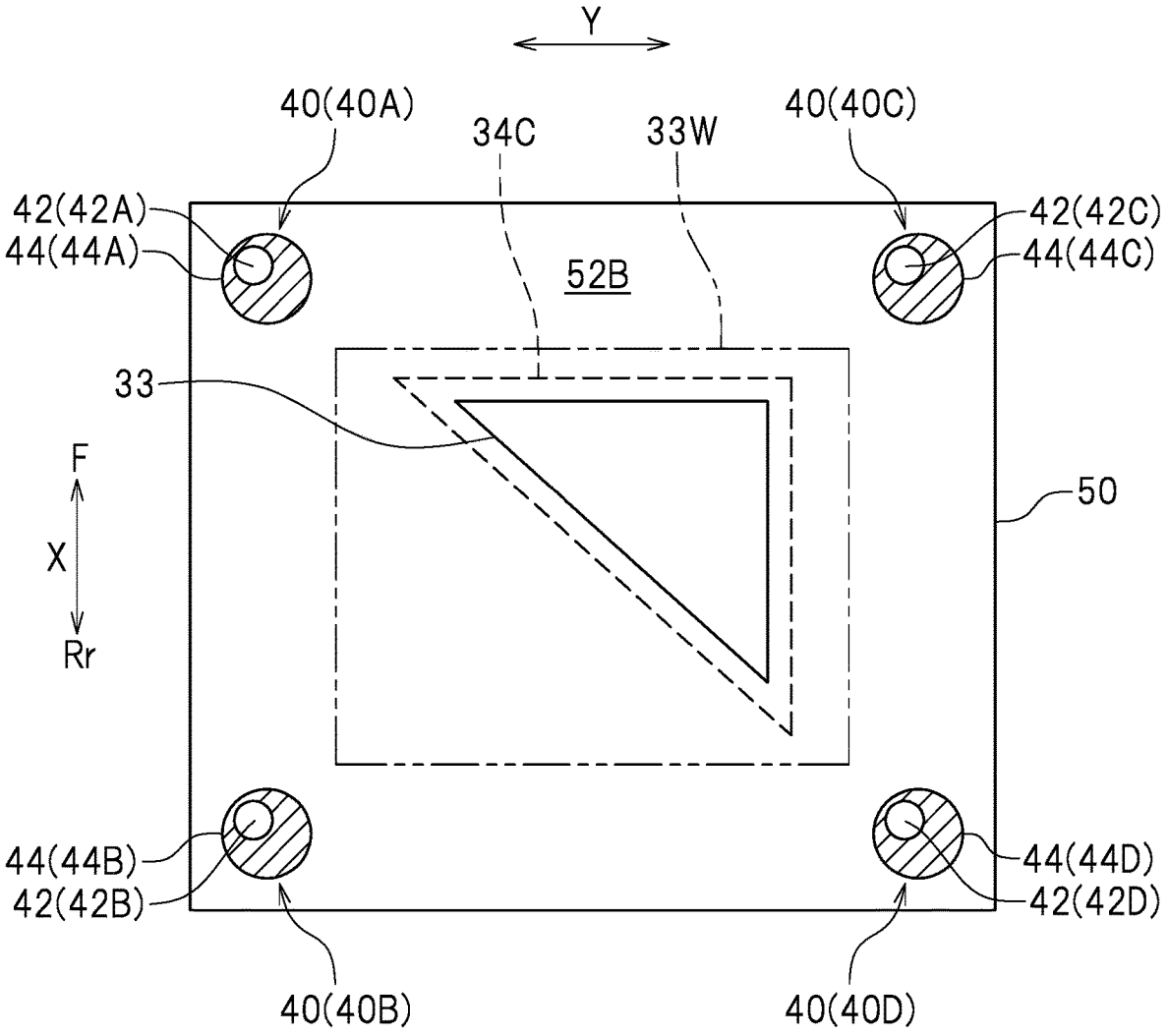
FIG. 9 is a plan view of the back side of the medium according to the second preferred embodiment of the present invention.
Figure 10:
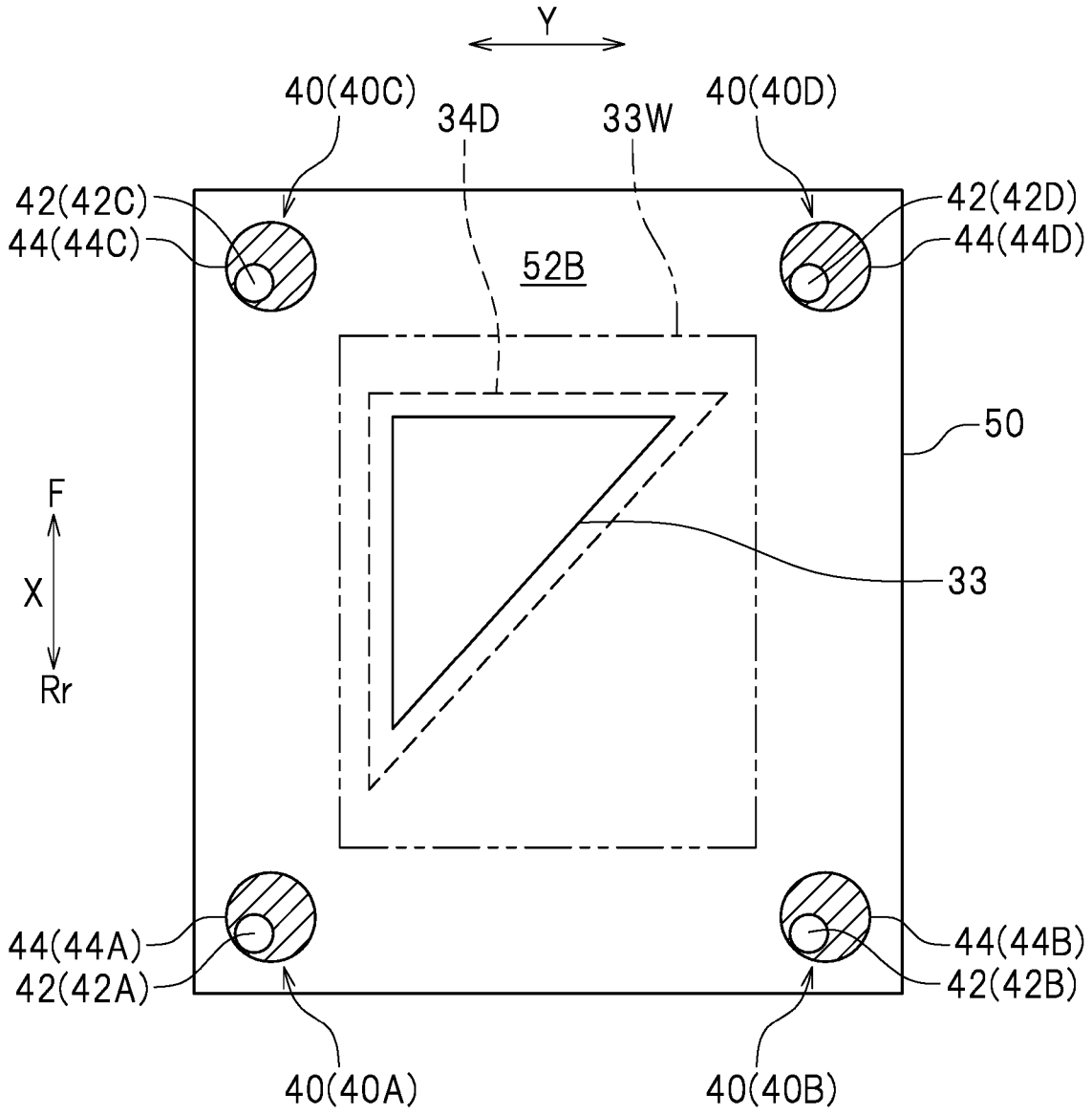
FIG. 10 is a plan view of the back side of the medium according to the second preferred embodiment of the present invention.
Figure 11:
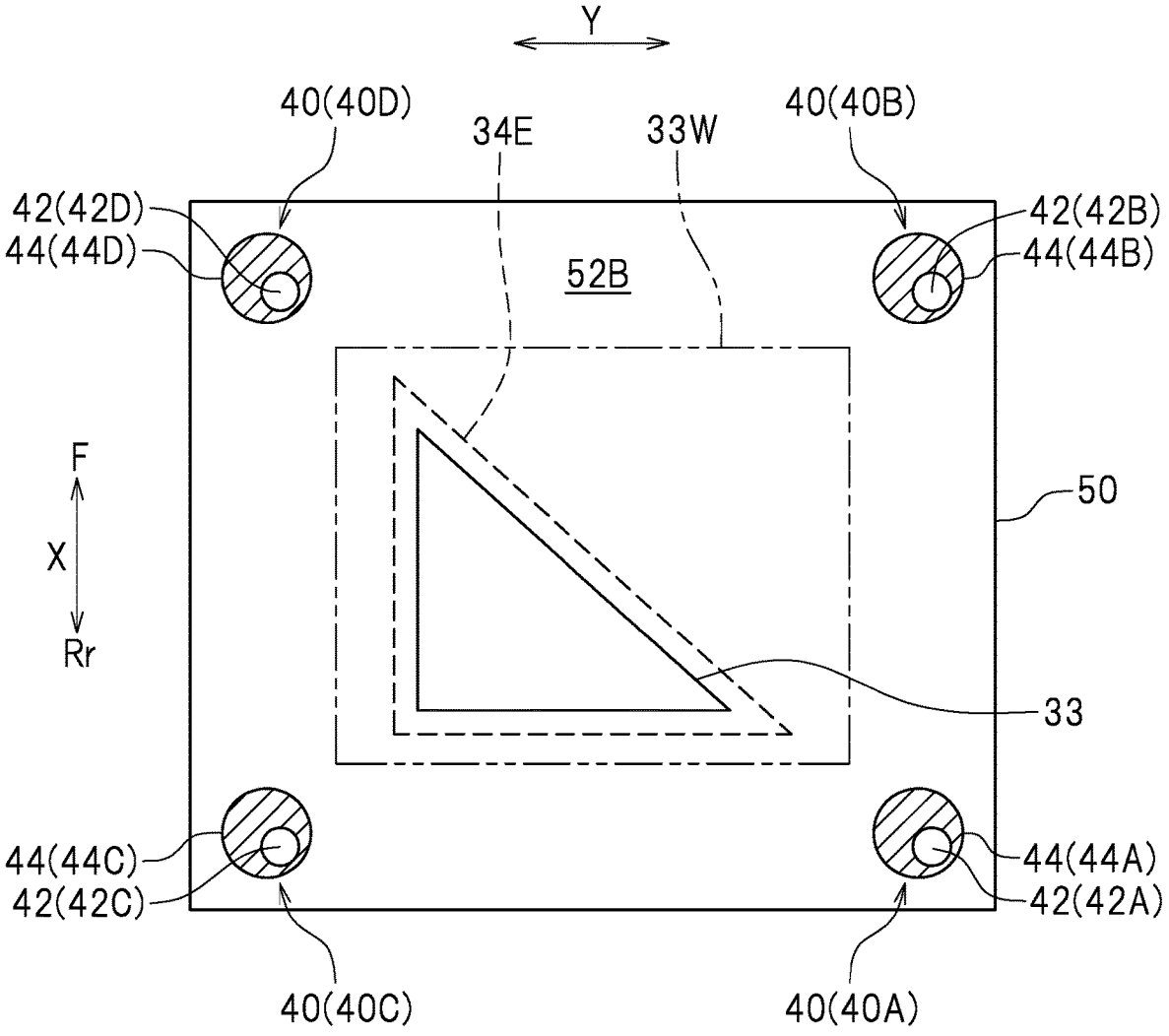
FIG. 11 is a plan view of the back side of the medium according to the second preferred embodiment of the present invention.
Figure 12:
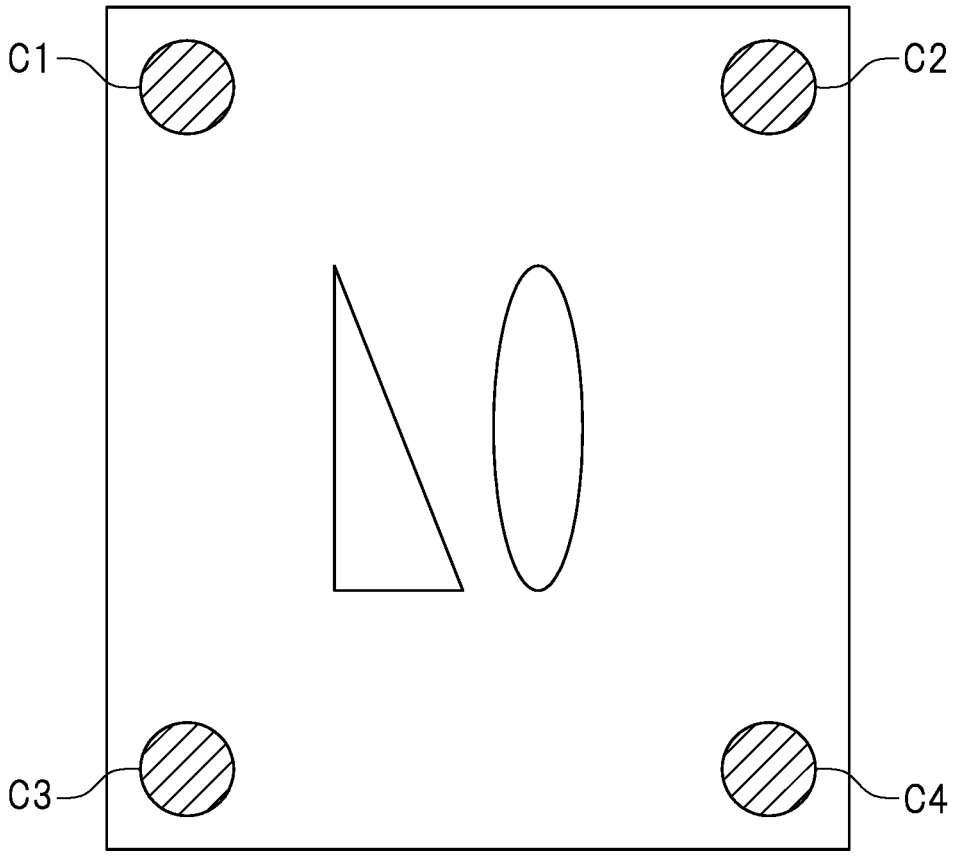
FIG.12 PRIOR ART
FIG. 12 is a plan view of the front side of a medium on which crop marks known in the art are printed.
Figure 13:
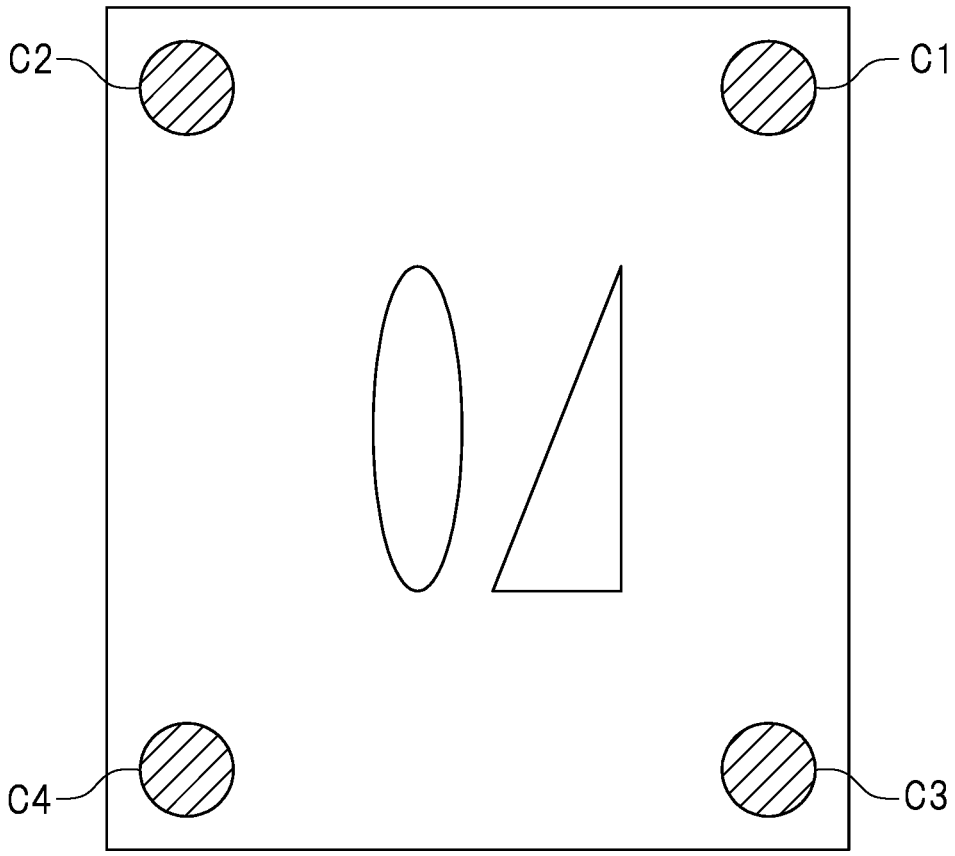
FIG.13 PRIOR ART
FIG. 13 is a plan view of the back side of the medium known in the art.

When the front/back determiner 91 has determined that the medium 50 is placed, with the back side 52B facing upward, the rotation determiner 95 determines the rotation state of the medium 50 (or the two-dimensional orientation of the medium 50) using the crop marks 40. Specifically, the rotation determiner 95 determines the rotation state of the medium 50 in accordance with the direction in which the center of the first crop mark 42 is deviated relative to the center of the second crop mark 44. In one example, suppose that as illustrated in FIG. 9, the center of each first crop mark 42 is deviated diagonally upward and leftward relative to the center of the associated second crop mark 44. In this case, the rotation determiner 95 determines that the medium 50 is placed on the platen 2, with the medium 50 rotated 90 degrees counterclockwise. In another example, suppose that as illustrated in FIG. 10, the center of each first crop mark 42 is deviated diagonally downward and leftward relative to the center of the associated second crop mark 44. In this case, the rotation determiner 95 determines that the medium 50 is placed on the platen 2, with the medium 50 rotated 180 degrees counterclockwise or clockwise. In still another example, suppose that as illustrated in FIG. 11, the center of each first crop mark 42 is deviated diagonally downward and rightward relative to the center of the associated second crop mark 44. In this case, the rotation determiner 95 determines that the medium 50 is placed on the platen 2, with the medium 50 rotated 90 degrees clockwise. Although the "unrotated" state is a state where the center of each first crop mark 42 is deviated diagonally upward and rightward relative to the center of the associated second crop mark 44 in this preferred embodiment, the direction in which the center of each first crop mark 42 is deviated relative to the center of the associated second crop mark 44 is not limited to any particular direction. The "unrotated" state is naturally not limited to the state where the center of each first crop mark 42 is deviated diagonally upward and rightward relative to the center of the associated second crop mark 44.

Suppose the front/back determiner 91 has determined that the medium 50 is placed, with the back side 52B facing upward, and the rotation determiner 95 has determined that the medium 50 is placed, with the medium 50 rotated 90 degrees counterclockwise, 180 degrees, or 90 degrees clockwise. In this case, the cut line corrector 92 corrects a cut line stored in the memory 75, such that the cut line assumes a suitable inverted position responsive to the rotation state of the medium 50. In one example, suppose the front/back determiner 91 has determined that the medium 50 is placed, with the back side 52B facing upward, and the rotation determiner 95 has determined that the medium 50 is placed, with the medium 50 rotated 90 degrees counterclockwise. In this case, the cut line corrector 92 corrects a cut line such that the cut line assumes an inverted position and is rotated 90 degrees counterclockwise (see a cut line 34C illustrated in FIG. 9). Consequently, the cutting apparatus 1 effects suitable cutting on the medium 50 along the cut line 34C, 34D, or 34E responsive to the rotation state of the medium 50.

The cutting apparatus 1 according to this preferred embodiment not only makes a front/back determination on the medium 50 but also determines the rotation state of the medium 50 using the asymmetrical crop marks 40 each including the first crop mark whose center is deviated in one direction relative to the center of the second crop mark 44. The cutting apparatus 1 according to this preferred embodiment automatically corrects a cut line such that the cut line assumes a suitable position responsive to the rotation state of the medium 50. Thus, if the user accidentally places the rotated medium 50 on the platen 2 in cutting the medium 50 from the back side 52B, the cutting apparatus 1 would be able to effect cutting without correcting the position of the medium 50.

In this preferred embodiment, the four crop marks 40A to 40D have the same or substantially the same shape and size, and the center of each first crop mark 42 is deviated in one direction relative to the center of the associated second crop mark 44. Thus, whichever rotated position the medium 50 assumes, detection of the first crop mark (e.g., the lower left crop mark) makes it possible to make a front/back determination on the medium 50 and determine the rotation state of the medium 50. Accordingly, this preferred embodiment skips the step of making a front/back determination on the medium 50 and determining the rotation state of the medium 50 using the second and subsequent crop marks. Consequently, the sensor 25 does not have to search for the first crop marks 42, resulting in a reduction in the time required for movement of the sensor 25.

This preferred embodiment involves making a front/back determination on the medium 50 and determining the rotation state of the medium 50 using the asymmetrical crop marks 40 each including the first crop mark 42 whose center is deviated in one direction relative to the center of the second crop mark 44. Suppose the front/back determiner 91 has determined that the medium 50 is placed, with the back side 52B facing upward, and the rotation determiner 95 has determined that the medium 50 is rotated. In this case, this preferred embodiment involves automatically correcting a cut line such that the cut line assumes a suitable inverted position responsive to the rotation state of the medium 50. An alternative preferred embodiment may involve making settings to notify the user that the medium 50 is rotated without correcting a cut line. In one example, upon determining that the medium 50 is rotated, the rotation determiner 95 may cause the display device 72 to present an alarm indicating that the orientation of the medium 50 is not proper. Upon receiving the alarm presented on the display device 72, the user is able to reset the medium 50 such that the medium 50 is oriented in a proper direction.

In each of the foregoing preferred embodiments, each second crop mark 44 is larger in size than the associated first crop mark 42 such that each second crop mark 44 covers the associated first crop mark 42. When only the second crop mark 44 is detected by the sensor 25, the front/back determiner 91 determines that the medium 50 is placed, with the front side 52A facing upward. Alternatively, each first crop mark 42 may be larger in size than the associated second crop mark 44. In one example, each crop mark 40 may include: the first crop mark 42 printed on the front side 52A of the medium 50 with a first color; and the second crop mark 44 printed over the first crop mark 42 with a second color different from the first color and smaller in size than the first crop mark 42 such that the second crop mark 44 is located inside the first crop mark 42. In such an example, the front/back determiner 91 preferably determines that the medium 50 supported on the platen 2 is placed, with the front side 52A facing upward, when a pattern including the first crop mark 42 and the second crop mark 44 overlapping one another is detected by the sensor 25, and determines that the medium 50 supported on the platen 2 is placed, with the back side 52B facing upward, when only the first crop mark 42 is detected by the sensor 25.

The cutting apparatus 1 according to each of the foregoing preferred embodiments includes the print head 10 in addition to the cutting head 20 and thus has a printing function. Cutting apparatuses according to preferred embodiments of the present invention, however, do not necessarily have to include the print head 10. In other words, the cutting apparatuses according to preferred embodiments of the present invention may be a cutting apparatus having no printing function. In such a case, an image and crop marks are printed by a printer separate from the cutting apparatus.

The cutting apparatuses effect cutting on a medium on which the image and crop marks have been printed by the printer.

In each of the foregoing preferred embodiments, the crop marks 40A to 40D each preferably include the first crop mark 42 and the second crop mark 44 and are used to make a front/back determination. It is, however, only required that at least one of the crop marks 40A to 40D is able to be used to make a front/back determination. In one example, one of the four crop marks 40A to 40D may be used to make a front/back determination. At least three crop marks are necessary to position of the cutting head 20. In one example, a total of three crop marks may each be printed on a portion of the medium 50 outward of an associated one of the four corners of the rectangular region 33W including the image 33.

In each of the foregoing preferred embodiments, the cutting apparatus 1 preferably moves the print head 10 and the cutting head 20 in the main scanning direction and convey the medium 50 in the sub-scanning direction. The cutting apparatus 1, however, is only required to move the print head 10 and the cutting head 20 two-dimensionally relative to the medium 50. In one example, the cutting apparatus 1 may move the print head 10 and the cutting head 20 in the main scanning direction and the sub-scanning direction. In this example, the cutting apparatus 1 may include: a flatbed to support the medium 50; a guide rail supporting the print head 10 and the cutting head 20 such that the print head 10 and the cutting head 20 are movable in the main scanning direction; a first driving device, such as a motor, to drive the print head 10 and the cutting head 20 in the main scanning direction; a rail supporting the guide rail such that the guide rail is movable in the sub-scanning direction; and a second driving device, such as a motor, to drive the guide rail in the sub-scanning direction.

In each of the foregoing preferred embodiments, the controller 60 of the cutting apparatus 1 includes the memory 75 and the cutting controller 90. The controller 60, however, does not necessarily have to include the memory 75 or the cutting controller 90. In one example, the memory 75 and the cutting controller 90 may be provided in the external computer 70, and information on the crop marks 40 detected by the sensor 25 may be sent to the external computer 70, so that the computer 70 carries out processes in accordance with the information.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A cutting apparatus comprising:

a support that supports a medium made of a transparent material, the medium including a front side and a back side opposite to the front side;

a print head that performs printing on the medium supported on the support;

a cutting head that cuts the medium supported on the support;

a printing controller that performs control to cause the print head to face the front side of the medium and print an image and a crop mark on the front side;

a cutting controller that performs control to cause the cutting head to face the medium and cut the medium;

a memory that stores a cut line provided for the image and along which the medium is to be cut by the cutting head when the medium supported on the support is placed, with the front side facing upward; and a crop mark detector that detects the crop mark; wherein the crop mark includes a first crop mark and a second crop mark;

the printing controller includes a crop mark print controller that prints the first crop mark on the front side of the medium with a first color and then prints the second crop mark over the first crop mark with a second color different from the first color, the second crop mark being larger in size than the first crop mark such that the second crop mark covers the first crop mark; and the cutting controller includes:

a front/back determiner that determines that the medium supported on the support is placed, with the front side facing upward, when the second crop mark is detected by the crop mark detector and the first crop mark is not detected by the crop mark detector, and determines that the medium supported on the support is placed, with the back side facing upward, when a pattern including the first crop mark and the second crop mark overlapping one another is detected by the crop mark detector.

2. The cutting apparatus according to claim 1, wherein the cutting controller includes a cut line corrector that corrects the cut line such that the cut line assumes an inverted position when the front/back determiner has determined that the medium is placed, with the back side facing upward.

3. The cutting apparatus according to claim 2, wherein a center of the first crop mark is deviated in one direction relative to a center of the second crop mark.

4. The cutting apparatus according to claim 3, wherein the cutting controller further includes a rotation determiner that determines a rotation state of the medium in accordance with a direction in which the center of the first crop mark is deviated relative to the center of the second crop mark.

5. The cutting apparatus according to claim 4, further comprising an alarm generator that issues an alarm indicating that the medium is rotated when the rotation determiner has determined that the medium is rotated.

6. The cutting apparatus according to claim 4, wherein the cut line corrector corrects the cut line such that the cut line assumes an inverted position responsive to the rotation state when the front/back determiner has determined that the medium is placed, with the back side facing upward, and the rotation determiner has determined that the medium is placed such that the medium is rotated.

7. The cutting apparatus according to claim 1, wherein the crop mark includes a total of four crop marks each printed on a portion of the front side of the medium outward of an associated one of four corners of a rectangular region including the image; and the cutting controller further includes a positioning controller that performs positioning of the cutting head in accordance with positions of three or all four of the crop marks detected by the crop mark detector.

8. The cutting apparatus according to claim 7, wherein the four crop marks have the same or substantially the same shape and size.

* * * * *